US011038303B2

(12) United States Patent
Nagasawa et al.

(10) Patent No.: US 11,038,303 B2
(45) Date of Patent: Jun. 15, 2021

(54) CABLE COVER

(71) Applicant: Yazaki Corporation, Tokyo (JP)

(72) Inventors: Masanori Nagasawa, Shizuoka (JP); Motoyoshi Suzuki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/812,631

(22) Filed: Mar. 9, 2020

(65) Prior Publication Data

US 2020/0295499 A1 Sep. 17, 2020

(30) Foreign Application Priority Data

Mar. 15, 2019 (JP) ..... JP2019-048523

(51) Int. Cl.

*H01R 13/516* (2006.01)
*H01R 13/502* (2006.01)
*H01R 13/58* (2006.01)
*H01R 13/50* (2006.01)

(52) U.S. Cl.

CPC ..... *H01R 13/516* (2013.01); *H01R 13/501* (2013.01); *H01R 13/502* (2013.01); *H01R 13/58* (2013.01)

(58) Field of Classification Search

CPC .. H01R 13/516; H01R 13/501; H01R 13/502; H01R 13/5829; H01R 13/5845; H01R 13/5894

USPC ..... 439/595, 467

See application file for complete search history.

(56) References Cited

U.S. PATENT DOCUMENTS 4,759,723 A * 7/1988 Siemon ..... H01R 4/2433 439/409
4,952,168 A * 8/1990 Schieferly ..... H01R 13/501 439/467
5,211,706 A * 5/1993 Polgar ..... H01R 13/506 439/464
5,347,084 A 9/1994 Roney et al.
5,391,092 A * 2/1995 Sumida ..... H01R 13/516 439/470
5,586,916 A * 12/1996 Shinji ..... H01R 13/501 439/448
5,872,335 A * 2/1999 Mullen, Jr. ..... H02G 3/0691 174/653
6,568,967 B2 * 5/2003 Inaba ..... H01R 13/501 439/701
2004/0187258 A1 9/2004 Tsuji (Continued)

FOREIGN PATENT DOCUMENTS

DE 102004014433 A1 11/2004
DE 10331286 A1 5/2005

(Continued)

*Primary Examiner* — Tho D Ta
(74) *Attorney, Agent, or Firm* — Sughrue Mion, PLLC

(57) ABSTRACT

A cable cover for attached to a side of a rear surface of a housing of a connector and for covering a cable pulled out from the rear surface of the housing includes: a main body cover mounted on the side of the rear surface of the housing; a lid cover that is combined with the main body cover into a tubular shape and that covers the cable; and a hinge which couples the main body cover and the lid cover and in which a central portion is formed thinner than a root portion of the main body cover and a root portion of the lid cover.

2 Claims, 6 Drawing Sheets

(56) References Cited

U.S. PATENT DOCUMENTS

| | | | |
|---|---|---|---|
| 2009/0197450 | A1 | 8/2009 | Ooki et al. |
| 2016/0204543 | A1 | 7/2016 | Kanda et al. |

FOREIGN PATENT DOCUMENTS

| | | | |
|---|---|---|---|
| DE | 102007029593 | A1 | 1/2009 |
| DE | 102009007881 | A1 | 8/2009 |
| DE | 202008004954 | U1 | 9/2009 |
| DE | 102012212430 | A1 | 2/2014 |
| EP | 1 170 828 | A1 | 1/2002 |
| JP | 56010044 | U | 1/1981 |
| JP | 0051043 | A | 3/1993 |
| JP | 2004-127813 | A | 4/2004 |

* cited by examiner

CABLE COVER

CROSS-REFERENCE TO RELATED APPLICATIONS

The present application is based on, and claims priority from Japanese Patent Application No. 2019-048523, filed on Mar. 15, 2019, the entire contents of which are incorporated herein by reference.

TECHNICAL FIELD

The disclosure relates to a cable cover of a connector.

BACKGROUND

This kind of cable cover includes what is disclosed in JP 2004-127813 A. A cable cover in JP 2004-127813 A is attached to a rear surface side of a female housing of a waterproof connector, and is divided into two that are a main body cover and a lid cover and connected in an openable/closable manner by a hinge.

A pair of right and left holding boards is provided in a protruded manner in an attachment hole of the main body cover. When a pair of right and left protruded pieces of an attachment wall of the female housing is fitted into fitting grooves respectively provided in the holding boards, the main body cover is temporarily held by the female housing. Then, the lid cover is folded back at the hinge toward an upper surface of the main body cover, and a lock protrusion portion of the main body cover is fitted into a lock hole in a lock piece of the lid cover, whereby the main body cover and the lid cover are locked in a combined state.

SUMMARY

However, in the cable cover of JP 2004-127813 A, the hinge is formed with the same thickness in an entire region. Thus, there is a possibility that the hinge is bent in a part close to a root of the hinge instead of being bent in a central part of the hinge when being bent, and there is a possibility that it becomes difficult to assemble a main body cover and a lid cover.

Thus, the disclosure is provided to solve the above-described problem and is to provide a cable cover with which a hinge is more easily bent in assembling to a housing and assembling to the housing is easily performed.

A cable cover according to an embodiment is a cable cover that is attached to a side of a rear surface of a housing of a connector and that is to cover a cable pulled out from the rear surface of the housing, and includes: a main body cover mounted to the side of the rear surface of the housing; a lid cover that is combined with the main body cover into a tubular shape and covers the cable; and a hinge which couples the main body cover and the lid cover and in which a central portion is formed thinner than a root portion of the main body cover and a root portion of the lid cover.

With the cable cover according to the embodiment, the hinge can be easily bent when the cable cover is assembled to the housing, and the cable cover can be easily assembled to the housing.

DETAILED DESCRIPTION

Figure 1:
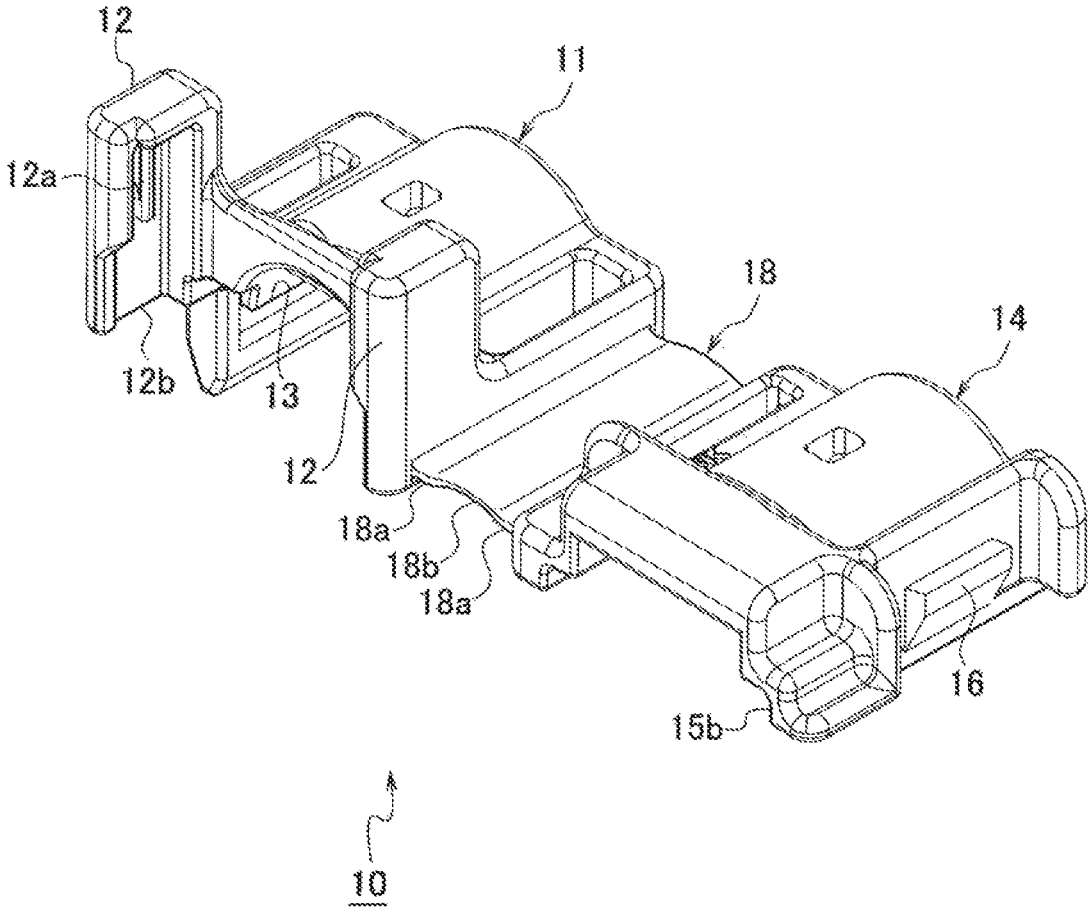
FIG. 1 is a perspective view illustrating a cable cover according to an embodiment.

Various embodiments will be described hereinafter with reference to the accompanying drawings.

As illustrated in FIGS. 1 to 3, and 6, a cable cover 10 according to an embodiment is attached to a side of a rear surface 21*a* of a female housing (housing) 21 of a female connector (connector) 20, and covers a cable 30 pulled out from the rear surface 21*a*. The cable cover 10 includes a main body cover 11 made of a synthetic resin and having a substantially semi-cylindrical shape, a lid cover 14 made of a synthetic resin and having a substantially semi-cylindrical shape, and a hinge 18 made of a synthetic resin and coupling the main body cover 11 and the lid cover 14. The main body cover 11 is attached to recessed cover locking grooves 22 each provided on respective side surfaces 21*b* of the female housing 21. The lid cover 14 is attached to a cover attachment protrusion 23 provided on a lower surface 21*c* of the female housing 21 in a state of being combined with the main body cover 11 into a tubular shape, and covers a front end side of a corrugated tube 32 through which the cables 30 penetrate.

A pair of attachment portions 12 is integrally formed on a front side of the main body cover 11 in such a manner as to be vertically extend in parallel. On an inner side of each of the attachment portions 12, a housing locking protrusion 12*a* formed in a protruded shaped is provided as a housing locking portion fitted into a corresponding cover locking groove 22. On an inner surface of the main body cover 11, a recessed portion (not illustrated) locked to a bellows-like protruded portion 32*a* of the corrugated tube 32 is provided. A lock hole 13 is provided at an end portion, on an opposite side of the hinge 18, of the main body cover 11.

Figure 3:
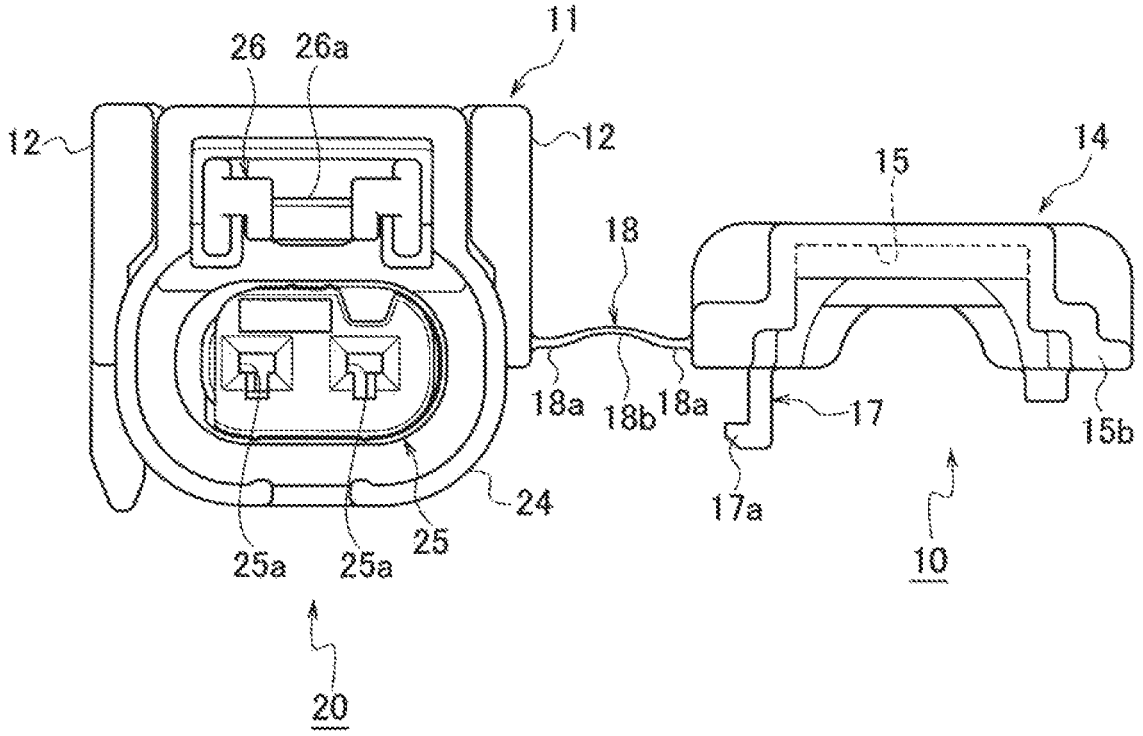
FIG. 3 is a front view illustrating a state in which the main body cover of the cable cover according to the embodiment is attached to the connector.
Figure 5:
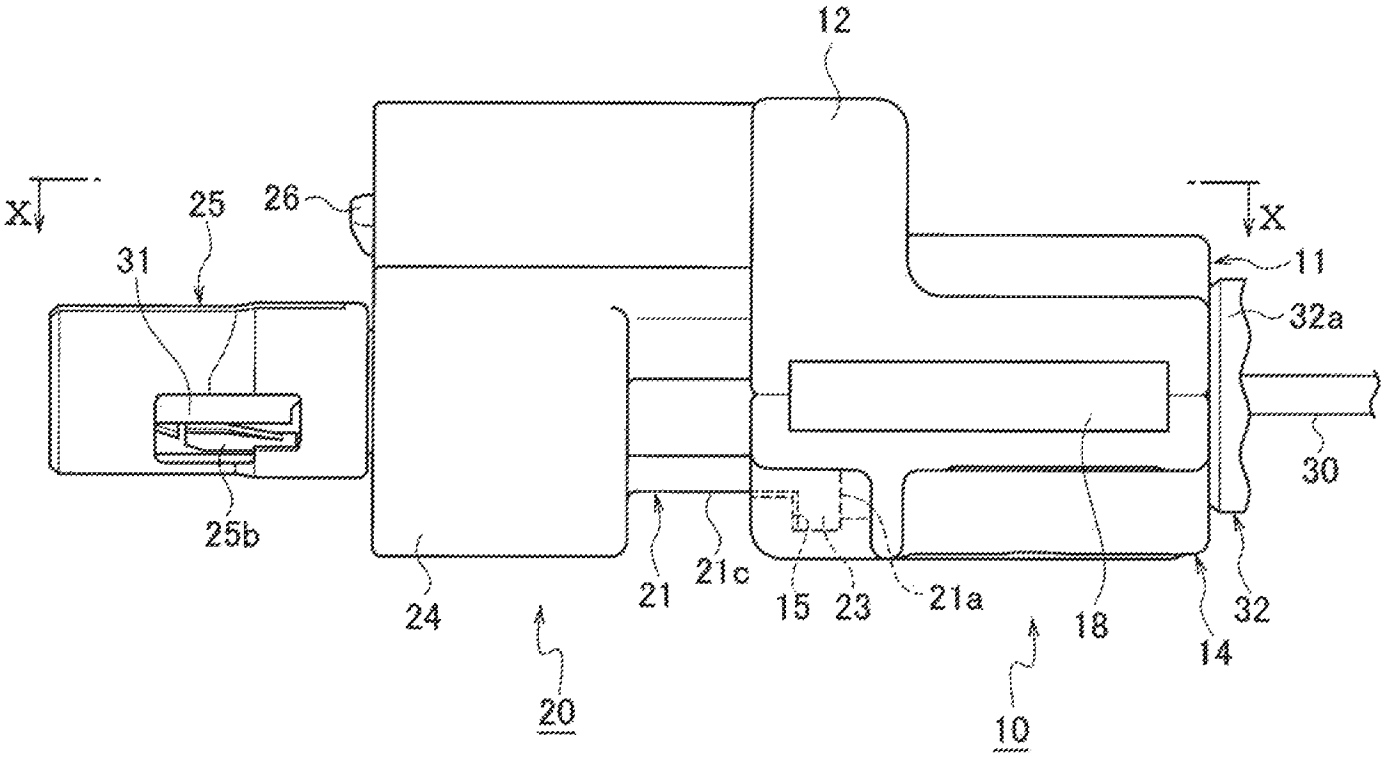
FIG. 5 is a side view illustrating a state in which the cable cover according to the embodiment is attached to the connector.
Figure 6:
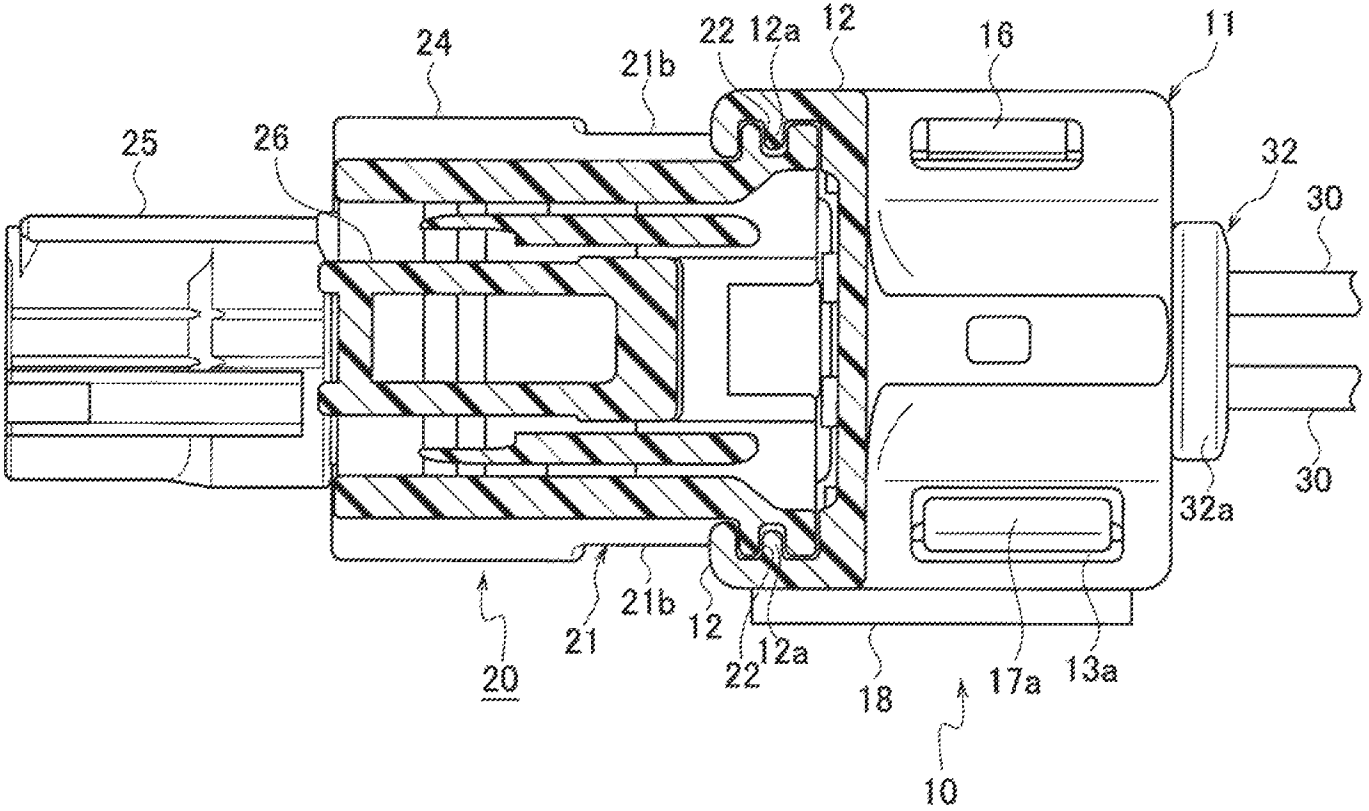
FIG. 6 is a sectional view along a line X-X in FIG. 5.

As illustrated in FIG. 5, on a front side of an inner surface of the lid cover 14, a recessed housing attachment groove 15 is provided as a housing attachment portion into which the cover attachment protrusion 23 of the female housing 21 is fitted. Also, a recessed portion (not illustrated) locked to the bellows-like protruded portion 32*a* of the corrugated tube 32 is provided on the inner surface of the lid cover 14. As illustrated in FIG. 1, a lock protrusion portion 16 locked into the lock hole 13 is provided at an end portion, on an opposite side of the hinge 18, of the lid cover 14. As illustrated in FIGS. 3 and 6, a protrusion portion 17*a* of a lock arm 17 locked to the lock protrusion portion 13*a* of the main body cover 11 is provided at an end portion, on a side of the hinge 18, of the lid cover 14. When the main body cover 11 and the lid cover 14 are combined into a tubular shape, a step portion 15*b* formed in a front portion on an outer side of the lid cover 14 is fitted into a notch portion 12*b* formed on a side of a lower end of the attachment portion 12 on an outer side of the main body cover 11.

Figure 4A:
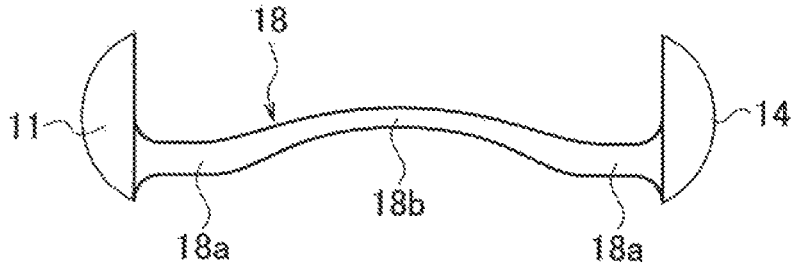
FIG. 4A is an enlarged front view of a hinge that connects the main body cover and a lid cover of the cable cover according to the embodiment.

As illustrated in FIG. 4A, the hinge 18 is integrally formed at facing end portions of the main body cover 11 and the lid cover 14. Also, the hinge 18 has a central portion 18*b* formed thinner than a root portion 18*a* of the main body cover 11 and a root portion 18*a* of the lid cover 14, and is formed in an arc surface shape curved upward as a whole. That is, in the hinge 18, the central portion 18*b* is curved in a bending direction of combining the main body cover 11 and the lid cover 14.

As illustrated in FIG. 6, the recessed cover locking groove 22 as a cover locking portion is formed on a rear end side of each of the side surfaces 21*b* of the female housing 21. As illustrated in FIG. 5, the cover attachment protrusion 23 as a cover attachment portion is provided at a rear end of the lower surface 21*c* of the female housing 21.

Figure 2:
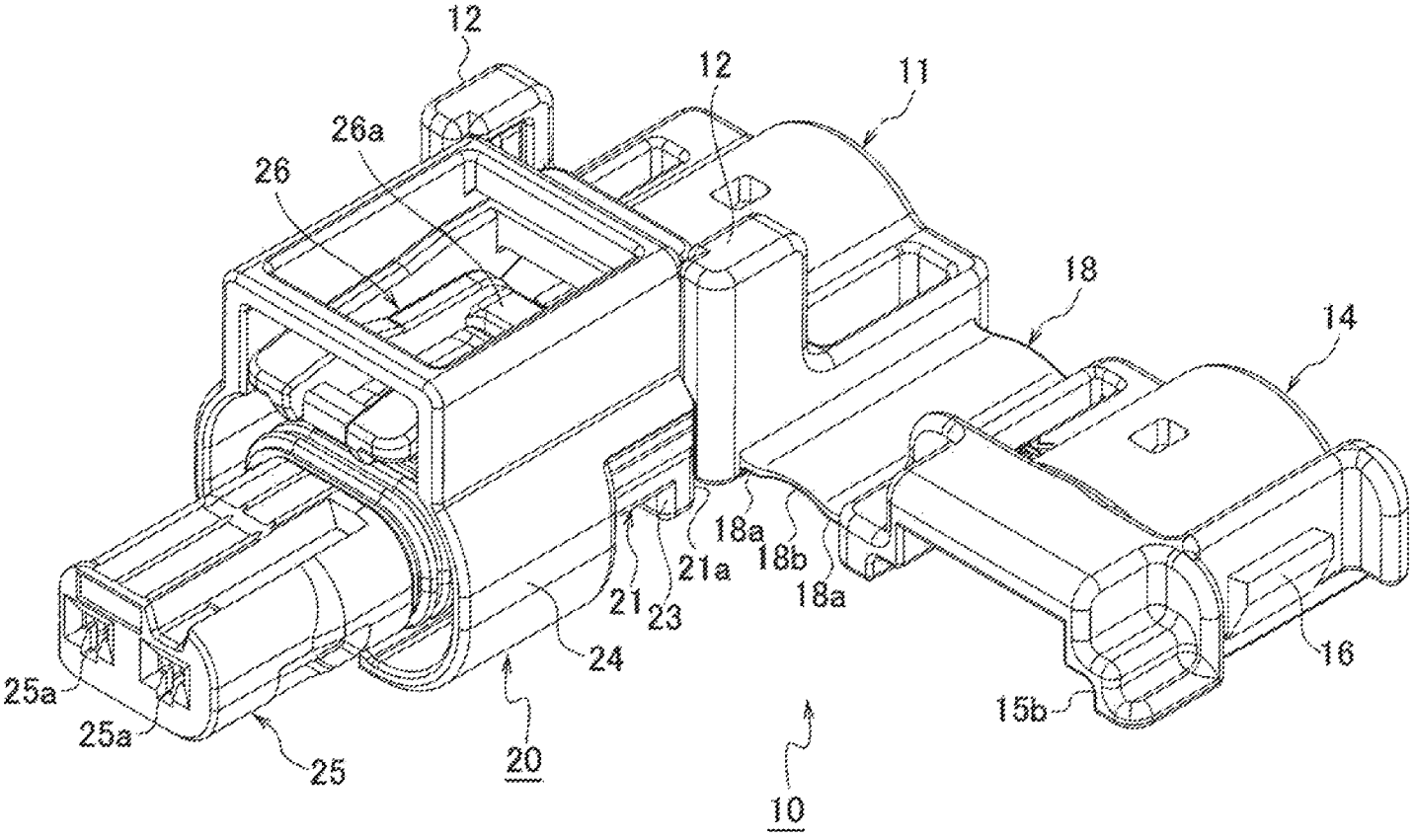
FIG. 2 is a perspective view illustrating a state in which a main body cover of the cable cover according to the embodiment is attached to a connector.

As illustrated in FIGS. 2, 5, and 6, the female housing 21 includes two terminal housing chambers (not illustrated) in which female terminals (terminal) 31 connected to the cables 30 are housed. Also, at a center of the female housing 21, a hood portion 24 having an opened front surface side and upper surface side into which a male housing (not illustrated) of a male connector (not illustrated) on an opposite side is fitted, and a tubular cap (sub-housing) 25 that is fitted into a front side and that has a terminal insertion hole 25*a*, into which a male terminal (not illustrated) on an opposite side is inserted, and a lance 25*b* to lock the female terminal 31 are provided.

As illustrated in FIG. 2, a lock arm 26 to lock a fitted state with respect to a male connector on the opposite side is provided in the hood portion 24 on a ceiling surface side of the female housing 21. An operation end 26*a* of the lock arm 26 is provided on a rear side of the upper surface opening of the hood portion 24.

With the cable cover 10 according to the embodiment, the hinge 18 that couples the main body cover 11 and the lid cover 14 is not straight but is in an arc manner, whereby a thin part of the central portion 18*b* of the hinge 18 is bent when the lid cover 14 is rotated, closed, and assembled with respect to the main body cover 11. Thus, assembly of the main body cover 11 and the lid cover 14 becomes easy. Also, since the hinge 18 is thinned from the root portion 18*a* of the main body cover 11 and the root portion 18*a* of the lid cover 14 toward the central portion 18*b*, bending becomes easier and assembly of the cable cover 10 is improved.

Figure 4B:
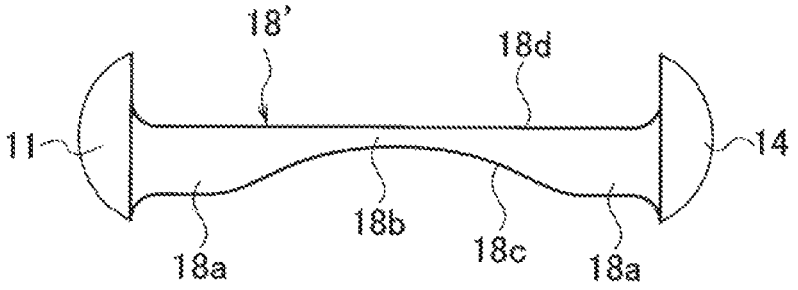
FIG. 4B is an enlarged front view of a hinge of a modification example of the embodiment.

FIG. 4B is an enlarged front view of a hinge 18' that is a modification example of the embodiment and that couples a main body cover 11 and a lid cover 14.

In the hinge 18' of the modification example of the embodiment, a central portion 18*b* is formed thinner than a root portion 18*a* of the main body cover 11 and a root portion 18*a* of the lid cover 14. Moreover, in the hinge 18', an inner surface of the central portion 18*b* on an inner peripheral side in a bending direction of combining the main body cover 11 and the lid cover 14 is formed as an arc surface 18*c*, and an outer surface of the central portion 18*b* on an outer peripheral side is formed as a straight surface 18*d*.

Similarly to the hinge 18 of the embodiment illustrated in FIG. 4A, in the hinge 18' of the modification example of the embodiment, the inner surface on the inner peripheral side in the bending direction of the central portion 18*b* is also the arc surface 18*c* curved upward. Thus, a function and an effect of the hinge 18' of the modification example of the embodiment similar to those in a case of the hinge 18 of the embodiment illustrated in FIG. 4A are acquired.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A cable cover that is attached to a side of a rear surface of a housing of a connector and that is to cover a cable pulled out from the rear surface of the housing, the cable cover comprising:

a main body cover mounted on the side of the rear surface of the housing;

a lid cover that is combined with the main body cover into a tubular shape and that covers the cable; and a hinge which couples the main body cover and the lid cover and in which a central portion is formed thinner than a root portion of the main body cover and a root portion of the lid cover, wherein in the hinge, an inner surface of the central portion on an inner peripheral side in a bending direction of combining the main body cover and the lid cover is formed as an arc surface, and an outer surface of the central portion on an outer peripheral side is formed as a straight surface;

wherein a section of the root portion of the main body cover and a section of the root portion of the lid cover each have a constant thickness.

2. A cable cover that is attached to a side of a rear surface of a housing of a connector and that is to cover a cable pulled out from the rear surface of the housing, the cable cover comprising:

a main body cover mounted on the side of the rear surface of the housing;

a lid cover that is combined with the main body cover into a tubular shape and that covers the cable;

a hinge which couples the main body cover and the lid cover and in which a central portion is formed thinner than a root portion of the main body cover and a root portion of the lid cover;

wherein in the hinge, the central portion is curved in a bending direction of combining the main body cover and the lid cover; and wherein a section of the root portion of the main body cover and a section of the root portion of the lid cover each have a constant thickness.

* * * * *